US008484784B2

(12) United States Patent
Mossbeck

(10) Patent No.: US 8,484,784 B2
(45) Date of Patent: Jul. 16, 2013

(54) SLOW ACTING POCKETED SPRING CORE HAVING FIBROUS MATERIAL GLUED TO POCKETS

(75) Inventor: Niels Mossbeck, Carthage, MO (US)

(73) Assignee: L&P Properly Management Company, South Gate, CA (US)

( * ) Notice: Subject to any disclaimer, the term of this patent is extended or adjusted under 35 U.S.C. 154(b) by 399 days.

(21) Appl. No.: 13/038,859

(22) Filed: Mar. 2, 2011

(65) Prior Publication Data

US 2011/0148014 A1 Jun. 23, 2011

Related U.S. Application Data

(63) Continuation-in-part of application No. 12/960,975, filed on Dec. 6, 2010, and a continuation-in-part of application No. 12/142,310, filed on Jun. 19, 2008, now Pat. No. 8,136,187, and a continuation-in-part of application No. 11/672,088, filed on Feb. 7, 2007, now Pat. No. 7,636,972.

(51) Int. Cl.
*A47C 25/00* (2006.01)

(52) U.S. Cl.
USPC ..... 5/720; 5/716

(58) Field of Classification Search
USPC ..... 5/720, 716, 655.8, 654.1; 29/91, 29/91.1
See application file for complete search history.

(56) References Cited

U.S. PATENT DOCUMENTS

| | | | | |
|---|---|---|---|---|
| 1,053,675 | A | | 2/1913 | Suekoff, Jr. |
| 1,455,847 | A | | 5/1923 | Meutsch |
| 2,615,180 | A | | 10/1952 | Wolter |
| 2,878,012 | A | | 3/1959 | Crites |
| 3,855,653 | A | | 12/1974 | Stalter, Sr. |
| 4,234,983 | A | | 11/1980 | Stumpf |
| 4,439,977 | A | | 4/1984 | Stumpf |
| 4,451,946 | A | | 6/1984 | Stumpf |
| 4,541,136 | A | | 9/1985 | Graebe |
| 4,854,023 | A | | 8/1989 | Stumpf |
| 4,895,352 | A | * | 1/1990 | Stumpf ..... 267/80 |
| 5,311,624 | A | | 5/1994 | Hutchinson |
| 5,424,115 | A | | 6/1995 | Stokes |
| 5,467,489 | A | * | 11/1995 | Cchen ..... 5/720 |
| 5,509,887 | A | | 4/1996 | Smith |
| 5,868,383 | A | | 2/1999 | Codos |
| 6,101,697 | A | | 8/2000 | Stumpf et al. |
| 6,131,892 | A | | 10/2000 | Stumpf |
| 6,173,464 | B1 | | 1/2001 | McCune et al. |
| 6,295,673 | B1 | | 10/2001 | Mossbeck |

(Continued)

FOREIGN PATENT DOCUMENTS

| | | |
|---|---|---|
| DE | 7926956 | 1/1980 |
| EP | 0052389 | 5/1982 |

(Continued)

OTHER PUBLICATIONS

Machine translation of FR2883462 (Sep. 29, 2006), two pages.

*Primary Examiner* — Fredrick Conley

(74) *Attorney, Agent, or Firm* — Wood, Herron & Evans, LLP

(57) ABSTRACT

Spring cushions (10) having slow-acting pocketed spring cores (12) characterized by the individual springs of the cores (12) being pocketed within semi-impermeable fabric material and a method of making such pocketed spring cores (12). Fibrous material is located between adjacent rows of pocketed springs to reduce noise.

19 Claims, 15 Drawing Sheets

U.S. PATENT DOCUMENTS

| | | | | |
|---|---|---|---|---|
| 6,487,738 | B1 | 12/2002 | Graebe | |
| 6,490,744 | B1 | 12/2002 | Schulz, Jr. | |
| 6,591,436 | B2 | 7/2003 | de Santis et al. | |
| 6,598,251 | B2 | 7/2003 | Habboub et al. | |
| 6,668,406 | B2 | 12/2003 | Spinks et al. | |
| 6,687,933 | B2 | 2/2004 | Habboub et al. | |
| 6,966,091 | B2 | 11/2005 | Barber | |
| 6,986,182 | B2 | 1/2006 | Mossbeck | |
| 7,636,972 | B2 | 12/2009 | Mossbeck et al. | |
| 8,011,046 | B2 | 9/2011 | Stjerna | |
| 8,136,187 | B2 | 3/2012 | Mossbeck et al. | |
| 8,176,608 | B2 * | 5/2012 | Mossbeck et al. | 29/91 |
| 8,307,523 | B2 * | 11/2012 | Mossbeck et al. | 29/91 |
| 2002/0162173 | A1 | 11/2002 | Formenti | |
| 2010/0212090 | A1 * | 8/2010 | Stjerna | 5/720 |

FOREIGN PATENT DOCUMENTS

| | | |
|---|---|---|
| EP | 0304798 | 3/1989 |
| EP | 0553772 | 8/1993 |
| EP | 0624332 | 5/1994 |
| EP | 1707081 | 4/2006 |
| FR | 2750584 | 1/1998 |
| FR | 2883462 | 9/2006 |
| JP | 2001340175 | 12/2011 |
| WO | 2005023059 | 3/2005 |
| WO | 2007102772 | 9/2007 |

* cited by examiner

SLOW ACTING POCKETED SPRING CORE HAVING FIBROUS MATERIAL GLUED TO POCKETS

CROSS REFERENCE TO RELATED APPLICATIONS

This application is a continuation-in-part of U.S. patent application Ser. No. 12/960,975 filed Dec. 6, 2010 entitled "Slow Acting Pocketed Spring Core Having Cushioning Material", which is fully incorporated herein. U.S. patent application Ser. No. 12/960,975 is a continuation-in-part of U.S. patent application Ser. No. 12/142,310 filed Jun. 19, 2008 entitled "Slow Acting Pocketed Spring Core and Method of Manufacturing Same", which is fully incorporated herein. U.S. patent application Ser. No. 12/142,310 is a continuation-in-part of U.S. patent application Ser. No. 11/672,088 filed Feb. 7, 2007 entitled "Slow Acting Pocketed Spring Core", now U.S. Pat. No. 7,636,972, which is fully incorporated herein.

TECHNICAL FIELD OF THE INVENTION

This invention relates to resilient cushions and, more particularly, to pocketed spring cores used in seating cushions or bedding mattresses and the method of manufacturing such pocketed spring cores.

BACKGROUND OF THE INVENTION

Spring cores are commonly used in seating or bedding products. Such spring cores are commonly made from assemblies or matrixes of multiple springs joined together directly as by helical lacing wires, or indirectly as by fabric within which each individual spring is contained. Such spring cores, whether the springs of the cores are connected directly or indirectly, are generally covered on the top and often on the bottom by pads of resilient foam as, for example, a pad of urethane or latex/urethane mix of foamed material. Within the last several years, more expensive cushions or mattresses have had the spring cores covered by a visco-elastic foam pad, which is slow acting or latex foam which is faster acting than visco-elastic foam. That is, the visco-elastic foam pad is slow to compress under load and slow to recover to its original height when the load is removed from the visco-elastic foam pad. These visco-elastic pads, as well as the latex pads, impart a so-called luxury feel to the mattress or cushion. These pads also, because of their closed cell structure, retain heat and are slow to dissipate body heat when a person sits or lies atop such a foam pad-containing cushion or mattress.

European Patent No. EP 1707081 discloses a pocketed spring mattress in which each pocket has a ventilation hole in order to improve the air flow into and out of the pocket. However, one drawback to such a product, depending upon the fabric used in the product, is that the fabric of the pocket may create "noise", as the sound is named in the industry. Such noise may be created by the fabric expanding upon removal of the load due to the coil spring's upwardly directed force on the fabric.

It is therefore an objective of this invention to provide a seating or bedding cushion or mattress which has the same luxury feel as a visco-elastic or latex pad-containing cushion, but without the heat retention characteristics of such a cushion or mattress.

Still another objective of this invention has been to provide a cushion or mattress having the same or a similar slow-to-compress and slow-to-recover to its original height luxury feel cushion or mattress as one containing foam pads, but which is substantially less expensive to manufacture.

Still another objective of this invention has been to provide a cushion or mattress having the same or a similar slow-to-compress and slow-to-recover to its original height luxury feel cushion or mattress which is not as "noisy" as known products comprising pocketed spring assemblies.

SUMMARY OF THE INVENTION

The invention of this application which accomplishes these objectives comprises a seating or bedding spring core made from an assembly of pocketed springs, each spring of which is contained within a fabric pocket. The fabric pocketing material within which the springs are contained is semi-impermeable to air flow through the fabric material. As used herein, the term "semi-impermeable" means that the fabric material, while permitting some airflow through the material, does so at a rate which retards or slows the rate at which a spring maintained in a pocket of the fabric may compress under load or return to its original height when a load is removed from the pocketed spring. In other words, air may pass through such a semi-impermeable material, but at a very reduced rate compared to the rate at which air usually flows freely through a fabric material.

In one embodiment of the invention, the semi-impermeable fabric material within which the springs of the pocketed spring assembly are contained is a spun-bonded polypropylene fabric available from Hanes Industries of Conover, N.C. under the name Elite 200. This Elite 200 fabric is coated with a layer of polyurethane. Such a non-woven fabric has a few pinholes, some of which may be covered by the coating. However, the fabric is not airtight due to the presence of some holes. The air permeability or porosity of a material is commonly measured using the American Society of Testing Materials ("ASTM") Method ASTM-D737, which is fully incorporated herein. However, when tested using this method, the material for this application may be not be quantified because the porosity is so low. Of course, the fabric material within which the pocketed springs are contained may be any semi-impermeable fabric material which, at ambient air pressure, retards or slows air pressure through the material. The fabric may be a woven or unwoven material which may be coated in a secondary process with a polymer to achieve the requisite semi-impermeable air flow characteristics described hereinabove.

In another embodiment of the invention, the semi-impermeable fabric pockets within which the springs of the pocketed spring assembly are contained comprise multiple layers of material. In one embodiment, the pocket comprises three layers: a middle layer of a polyolefin plastic material and outer layers of non-woven polypropylene fabric material. The outer layer of non-woven polypropylene fabric material provides strength and a satisfactory gluing or ultrasonic welding surface. The middle layer controls the air flow. The inner layer is made of non-woven polypropylene fabric material. The fabric may contain any number of layers of any desired material, including but not limited to polyester, polyolefin, polyurethane, polyethylene or other types of polymers. One or more holes may extend through all of the layers of the pocket (no matter how many there are) and enable air to slowly enter or exit the interior of the pocket, depending upon whether the pocket is under a load.

In accordance with the practice of this invention, the pocketed spring core assembly having the slow acting compression and slow-to-recover original height characteristics of this invention may be inexpensively manufactured upon the same pocketed spring machinery, with very little modification, which is now utilized to manufacture conventional pocketed spring assemblies. Expressed another way, the advantageous spring cushion assembly of this invention may be manufactured upon existing pocketed spring equipment without any substantial modification of that equipment or machinery. As a result, this advantageous pocketed spring core assembly with its unique compression and recovery characteristics is, in accordance with the practice of this invention, manufactured according to the current manufacturing processes of existing pocketed spring assemblies with only the fabric material utilized in the practice of the process being changed from an air permeable fabric, as is now conventional, to an air semi-impermeable fabric material. This conventional process, absent the unique fabric utilized in the practice of this invention, is completely illustrated and described in prior art patents as, for example, Stumpf U.S. Pat. No. 4,439,977; Stumpf et al U.S. Pat. No. 6,101,697; and, Santis et al U.S. Pat. No. 6,591,436. These patents all describe apparatus for manufacturing continuous strings of coil springs contained within fabric pockets. The fabric pockets of these springs are generally unsealed from one pocket to the next. But in accordance with the practice of this invention, the seals are all continuous and preferably, by sinusoidal-shaped seals, so as to create individual pockets. After being formed into continuous strings of pocketed springs, the springs are in accordance with the practice of this invention and are cut into strings of predetermined discrete lengths, which are then assembled by gluing together the strings either directly or indirectly via a sheet of fabric on the top or bottom of the side-by-side juxtapositioned strings of coils. Mossbeck U.S. Pat. No. 6,159,319 discloses such an assembly process.

One patent which discloses a point-bonded non-woven fabric and method of making that fabric suitable for use in the practice of this invention is Stokes U.S. Pat. No. 5,424,115. The disclosures and contents of the above-identified patents are hereby incorporated by reference in their entirety for purposes of completing the disclosure of this application.

The primary advantage of this invention is that it gives rise to a relatively inexpensive seating or bedding cushion, which has the luxurious slow-acting compression and height recovery characteristics of heretofore expensive visco-elastic foam-containing cushions. And in accordance with the practice of this invention, the cushion having these characteristics may be relatively inexpensively manufactured on currently existing equipment with very little modification of that production equipment.

In one embodiment of the invention, the bedding or seating cushion core includes cushioning material in the form of foam, fabric or other like material layered, placed or located between adjacent strings of springs or rows of pocketed springs. The strings of springs may be secured in any known manner to the layers of cushioning material.

In another embodiment of the invention, the bedding or seating cushion core includes fibrous material residing between adjacent strings of springs or rows of pocketed springs. The strings of springs may be secured in any known manner to the layers of fibrous material, such as being secured with adhesive sprayed on the strings of springs or fibrous material. The semi-impermeable fabric may have at least one hole through the fabric to increase air flow into the pockets after a load has been removed from the product.

These and other objects and advantages of this invention will be more readily apparent from the following drawings, in which:

DETAILED DESCRIPTION OF THE DRAWINGS

Figure 1:
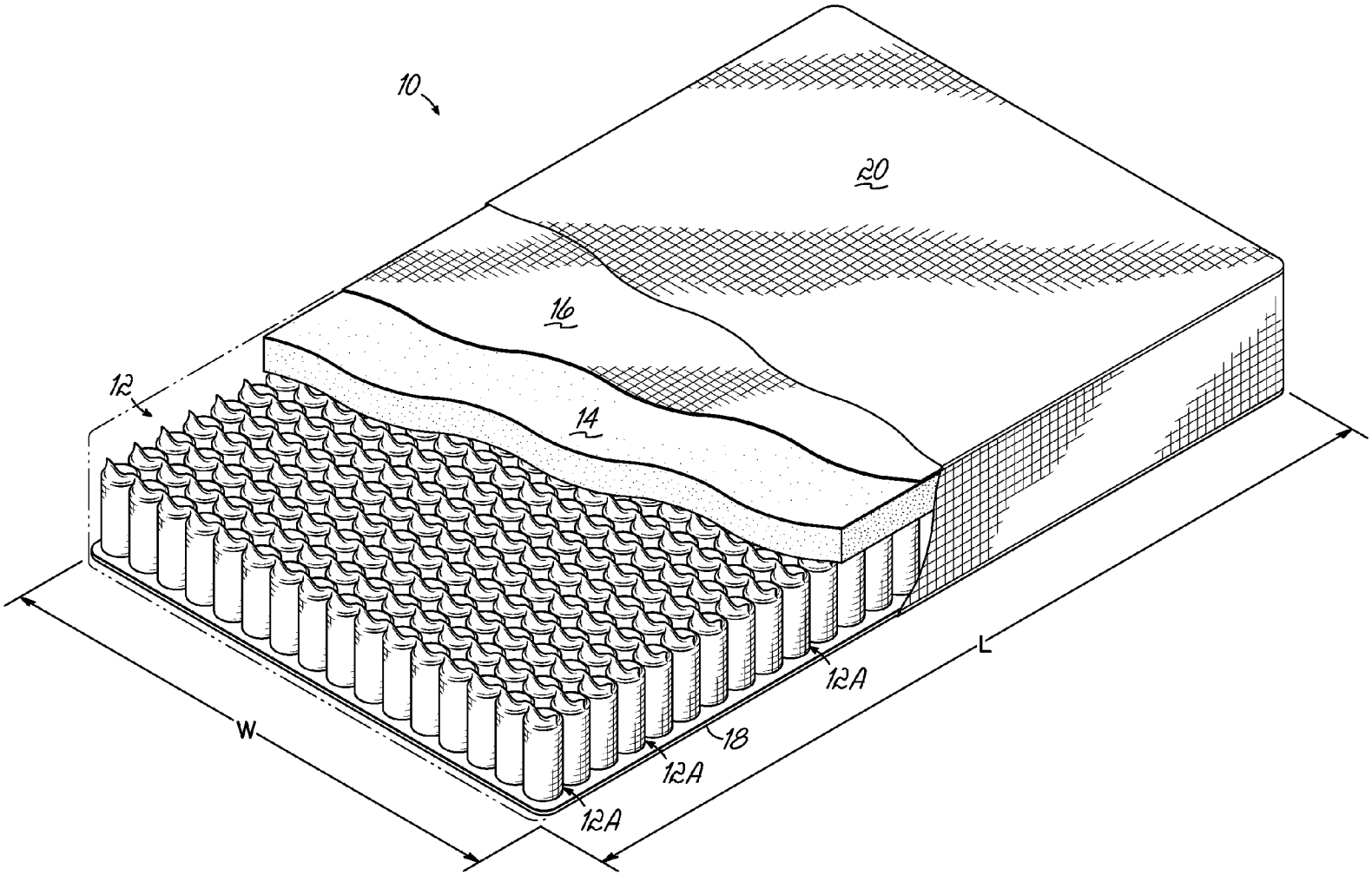
FIG. 1 is a perspective view, partially broken away, of a cushion incorporating the pocketed spring core invention of this invention.

With reference to FIG. 1, there is illustrated a cushion in the form of a single-sided mattress 10 incorporating this invention. This cushion or mattress 10 comprises a pocketed spring core 12 over the top of which there is a conventional foam pad 14 covered by a fiber pad 16. This complete assembly is mounted upon a base 18 and is completely enclosed within an upholstered covering material 20.

While one embodiment of the invention described herein is illustrated and described as being embodied in a single-sided mattress, it is equally applicable to double-sided mattresses or seating cushions. In the event that it is utilized in connection with a double-sided mattress, then the bottom side of the spring core usually has a foam pad applied over the bottom side of the spring core and that pad is, in turn, covered by a fiber pad of cushioning material. According to the practice of this invention, though, either the foam pad or the fiber pad, or both, may be omitted while still practicing the invention of this application wherein the novel features reside in the pocketed spring core 12.

The pocketed spring core 12 may be made upon any conventional pocketing spring manufacturing machine and by any conventional pocketing spring process so long as the machine and process utilized the special fabric material to be described hereinbelow for pocketing the springs of the assembly. One machine and process suitable for creating the pocketing spring assembly 12 is described in Santis et al U.S. Pat. No. 6,591,436 assigned to the assignee of this application. With very little modification as described hereinbelow, that machine and process may be used in the practice of this invention. While that machine creates so-called "side seam pocketed coil springs", this invention is equally applicable to spring cores wherein the strings of springs have the longitudinal seam on the top of the string of pocketed springs rather than on the sides of the springs. Such top seamed pocketed spring cores and the methods by which they are manufactured are described, for example, in Stumpf U.S. Pat. No. 4,439,977 and Stumpf et al U.S. Pat. No. 6,101,697. With very little modification, as explained more fully hereinbelow, the machines and processes of these top seam pocketed spring assemblies may also be utilized in the practice of this invention.

Still with reference to FIG. 1, it will be seen that the pocketed spring core 12 is manufactured from multiple strings 12A of pocketed springs, each string of which extends across the full width of the product 10. These strings are connected in side-by-side relationship as, for example, by gluing the sides of the strings together in an assembly machine, such as the assembly machine disclosed in Mossbeck U.S. Pat. No. 6,159,319, so as to create an assembly or matrix of springs having multiple rows and columns of pocketed springs bound together as by gluing, welding or any other conventional assembly process commonly used to create pocketed spring cores.

Figure 3:
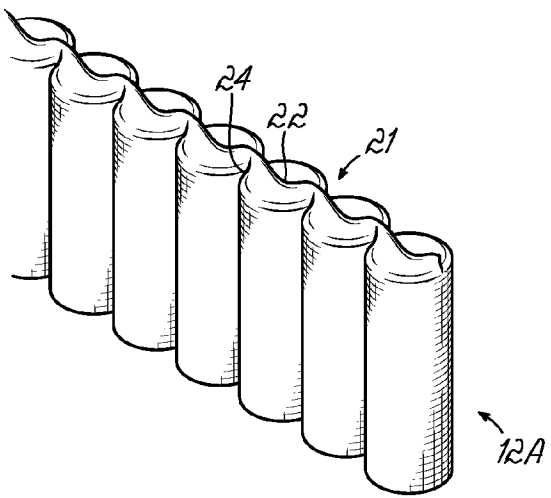
FIG. 3 is an enlarged perspective view of a portion of a string of pocketed coil springs used in the pocketed spring core of FIG. 1.

With reference now to FIG. 3, there is illustrated a portion of one string 12A of the pocketed spring core 12. This string differs from the strings of coil springs illustrated and described in U.S. Pat. No. 6,591,436 only in that the overlapped seam 21 of fabric is secured together by a sinusoidal wave-shaped welded seam 22 and the vertical welded seams 24 between adjacent coil springs in a string of pocketed coil springs is a continuous sinusoidal welded seam 24 rather than a discontinuous seam as in U.S. Pat. No. 6,591,436. These seams are accomplished by the welding horn of the machine having a sinusoidal-shaped welding element rather than multiple spaced protrusions on the welding head. As a result of these welded seam seals defining the spring-containing pockets of the string of coil springs, each spring of the string is sealingly enclosed within its individual pocket. If the fabric material defining these pockets and enclosing the springs therein were completely air-impermeable, then these pockets could only be compressed by compressing the air contained within the pockets. In actuality, and as explained more fully hereinafter, this fabric material is semi-impermeable so that the rate at which the springs compress when a load is placed upon the top of a pocketed spring core assembly containing the springs is only slowed or retarded by the air entrapped within the individual pockets as the pocketed spring assembly is compressed and, similarly, the rate of return of the compressed coil spring assembly to its original height after compression is retarded or slowed by the rate at which air may pass through the semi-impermeable fabric material into the interior of the individual pockets of the coil spring assembly.

Figure 2:
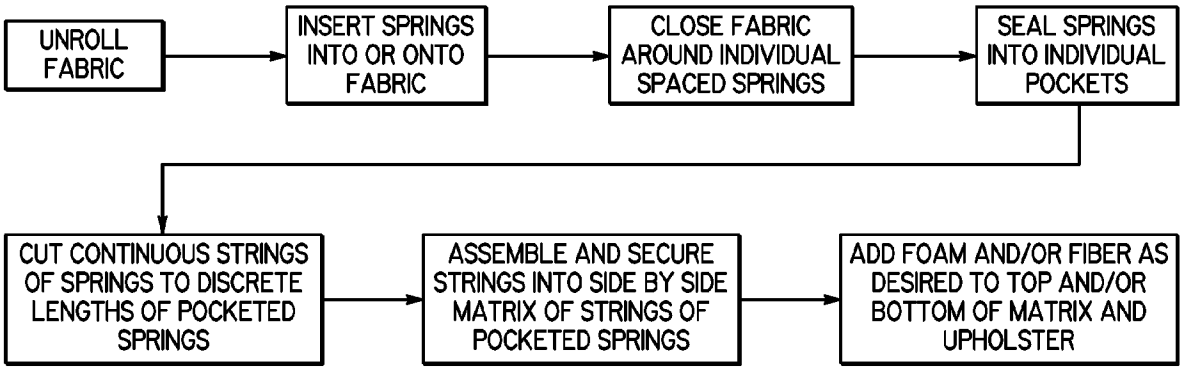
FIG. 2 is a schematic drawing of the process by which cushion spring cores made in accordance with the practice of this invention are manufactured.

With reference now to FIG. 2, there is illustrated the process by which the coil spring assembly of FIG. 1 is manufactured utilizing the machines and processes of the above-identified patents. This process comprises starting with a roll of fabric material which is unrolled and has springs either inserted between a fold of the fabric or placed onto the fabric. Thereafter, the fabric is enclosed around the individual spaced springs located either between the folded springs or on the top of the fabric material. The fabric is then closed around the spring by forming a longitudinal seal either along the side or tops of the spring. The individual pockets within which the springs are contained are then defined by vertical seams which extend for the height of the pocketed springs with each spring separated from the adjacent spring by the vertical seam. The resulting continuous string of pocketed springs is then cut into discrete lengths of pocketed springs which are then assembled and secured together in a side-by-side relationship to create the matrix of strings of pocketed springs illustrated in FIG. 1. The cushion is then completed by adding top cushioning materials as, for example, the pad of resilient foam material 14 and/or fiber 16 after which the complete assembly is encased within upholstered finishing material 20.

In accordance with the practice of this invention, the fabric material 15 within which the springs of the pocketed spring assembly are enclosed is a point-bonded, non-woven fabric material as, for example, the point-bonded, non-woven fabric material disclosed in U.S. Pat. No. 5,424,115. In accordance with the practice of this invention, this material has a coating of polyethylene or other suitable material sprayed onto or roller-coated onto one side of the fabric so as to make it semi-impermeable to air flow as described hereinabove.

Figure 4:
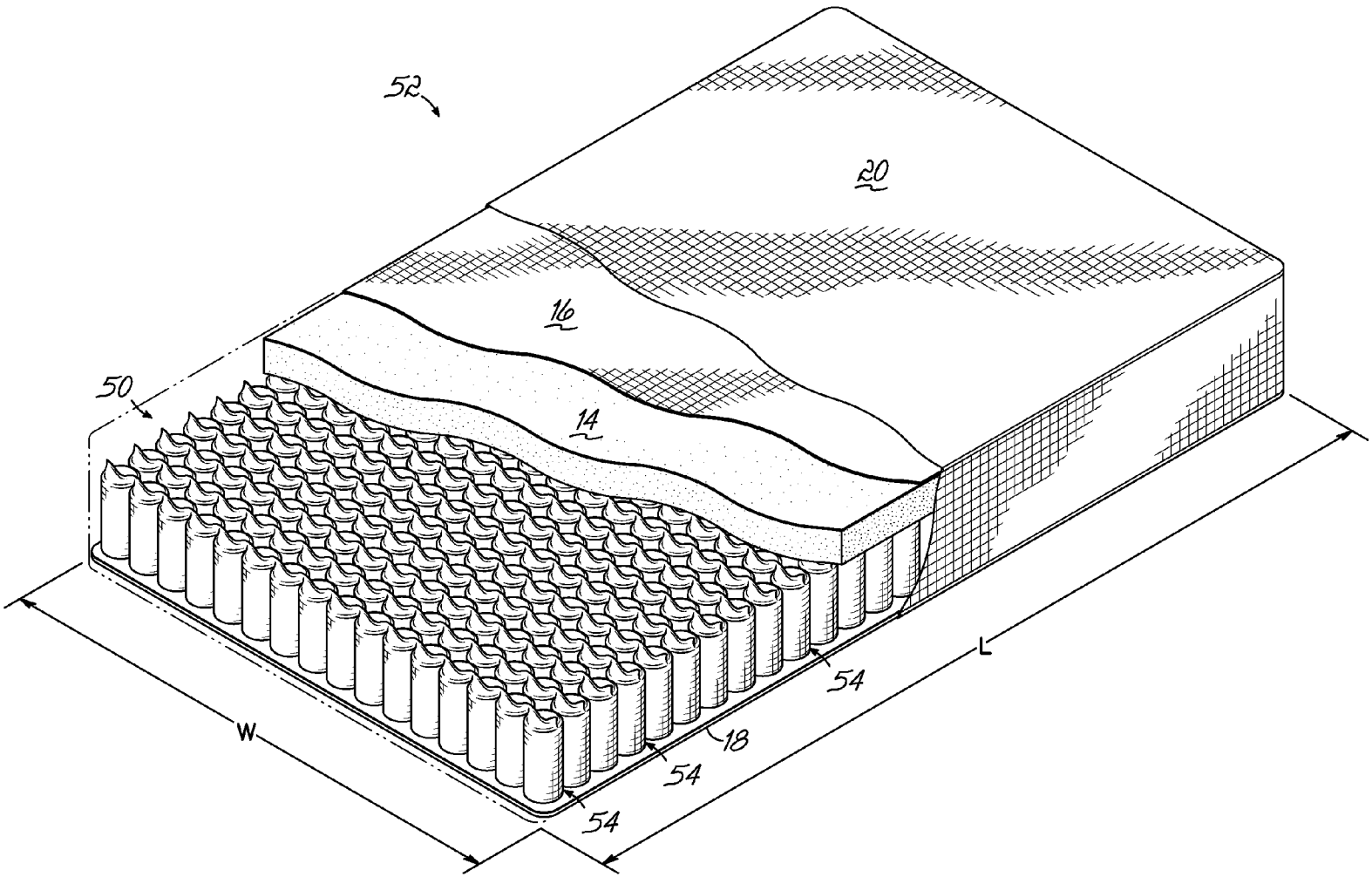
FIG. 4 is a perspective view, partially broken away, of a cushion incorporating an alternative embodiment of pocketed spring core.

FIG. 4 illustrates an alternative embodiment of pocketed spring core 50 incorporated into a single-sided mattress 52. Like the single-sided mattress 10 described above, this single-sided mattress 52 comprises a pocketed spring core, a conventional foam pad 14 on top of the pocketed spring core, a base 18, a fiber pad 16 and an upholstered covering material 20. Pocketed spring core 50 may be incorporated into any bedding or seating product or cushion, including a double-sided mattress, and is not intended to be limited to single-sided mattresses, like pocketed spring core 10. The product or mattress 52 has a width W extending between side surfaces of the product and a length L extending between end surfaces of the product. It is within the contemplation of this invention that the length and width be identical.

As shown in FIG. 4, pocketed spring core 50 is manufactured by joining together, in any known manner, multiple strings of springs 54, each string of springs 54 of which extends across the full width of the product 52. These strings of springs 54 are connected in side-by-side relationship as, for example, by gluing the sides of the strings together in an assembly machine, such as the assembly machine disclosed in Mossbeck U.S. Pat. No. 6,159,319, so as to create an assembly or matrix of springs having multiple rows and columns of pocketed springs bound together as by gluing, welding or any other conventional assembly process commonly used to create pocketed spring cores.

Figure 6:
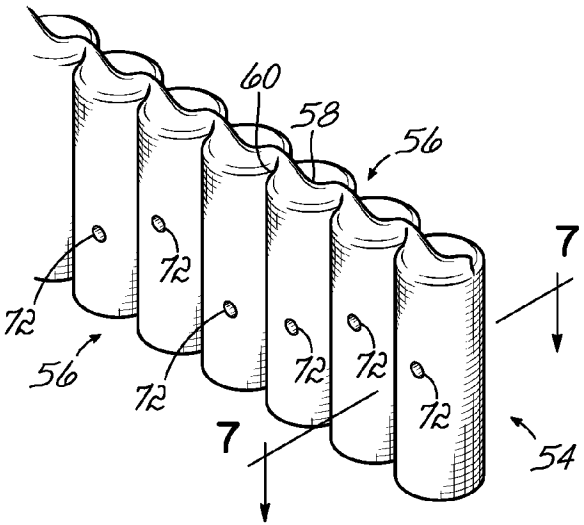
FIG. 6 is an enlarged perspective view of a portion of an alternative string of pocketed coil springs.

With reference now to FIG. 6, there is illustrated a portion of one string 54 of the pocketed spring core 50. This string of springs 54 differs from the strings of coil springs 12A illustrated and described above in that the pockets of fabric 56 secured together by a longitudinal seam 58 and the vertical welded seams 60 between adjacent coil springs 62 in the string of pocketed coil springs 54 are made of multiple-ply material. See FIG. 7.

Figure 7:
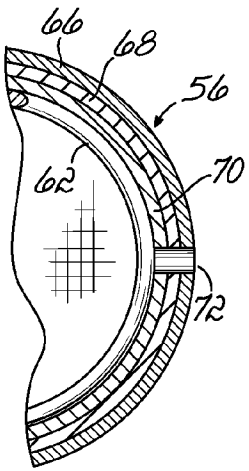
FIG. 7 is a cross-sectional view taken along the line 7-7 of FIG. 6.

As shown in FIG. 7, the pockets of fabric material 64 within which the springs 62 of the pocketed spring assembly 52 are enclosed is a three-layered fabric material or web comprising an outer layer 66 of non-woven polypropylene, a middle layer 68 of polyolefin plastic material and an inner layer 70 of non-woven polypropylene, like the outer layer 66. In accordance with the practice of this invention, one or more holes 72 extend through all three fabric layers of each pocket 56 so as to make the pockets 56 of the string of springs 54 semi-impermeable to air flow as described hereinabove. The size of the small hole or holes 72 of each pocket 56 may vary; in one embodiment these holes are 0.125 inches in diameter to create a way for air to escape in a controlled manner when a load is placed on the string of springs 54. See FIG. 6. Although the holes 72 are illustrated in specific locations, they may be located at any desired location with respect to the pockets 56 of the string of springs 54.

Figure 5:
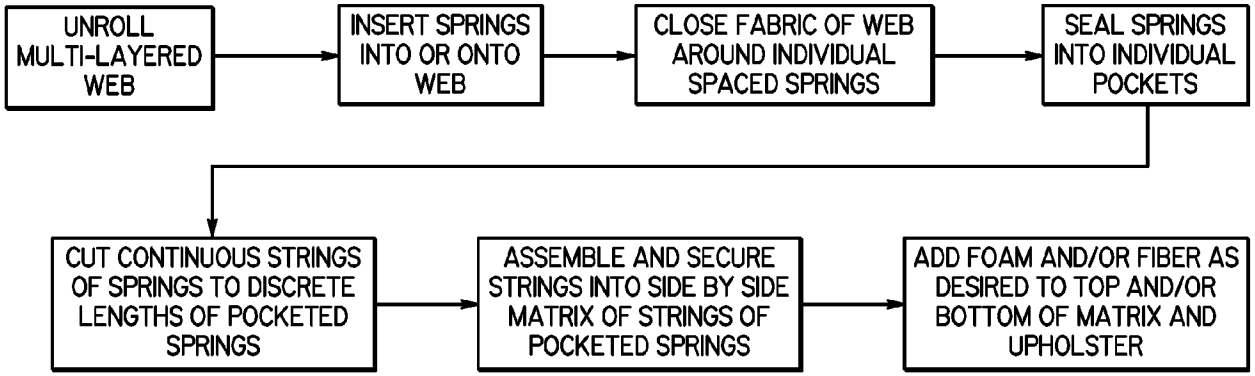
FIG. 5 is a schematic drawing of an alternative process by which cushion spring cores are manufactured.

With reference now to FIG. 5, there is illustrated the process by which the coil spring assembly of FIG. 4 is manufactured utilizing the machines and processes of the above-identified patents. This process comprises starting with a roll of multi-layered fabric material, or a web, which is unrolled and has springs either inserted between a fold of the fabric web or placed onto the fabric web. Thereafter, the three-layered fabric web is enclosed around the individual spaced springs located either between the folded springs or on the top of the fabric material. The fabric web is then closed around the spring by forming a longitudinal seal either along the side or tops of the spring. The individual pockets within which the springs are contained are then defined by vertical seams which extend for the height of the pocketed springs with each spring separated from the adjacent spring by the vertical seam. The resulting continuous string of pocketed springs is then cut into discrete lengths of pocketed springs which are then assembled and secured together in a side-by-side relationship to create the matrix of strings of pocketed springs illustrated in FIG. 4. The cushion is then completed by adding top cushioning materials as, for example, the pad of resilient foam material 14 and/or fiber 16 after which the complete assembly is encased within upholstered finishing material 20.

Figure 8:
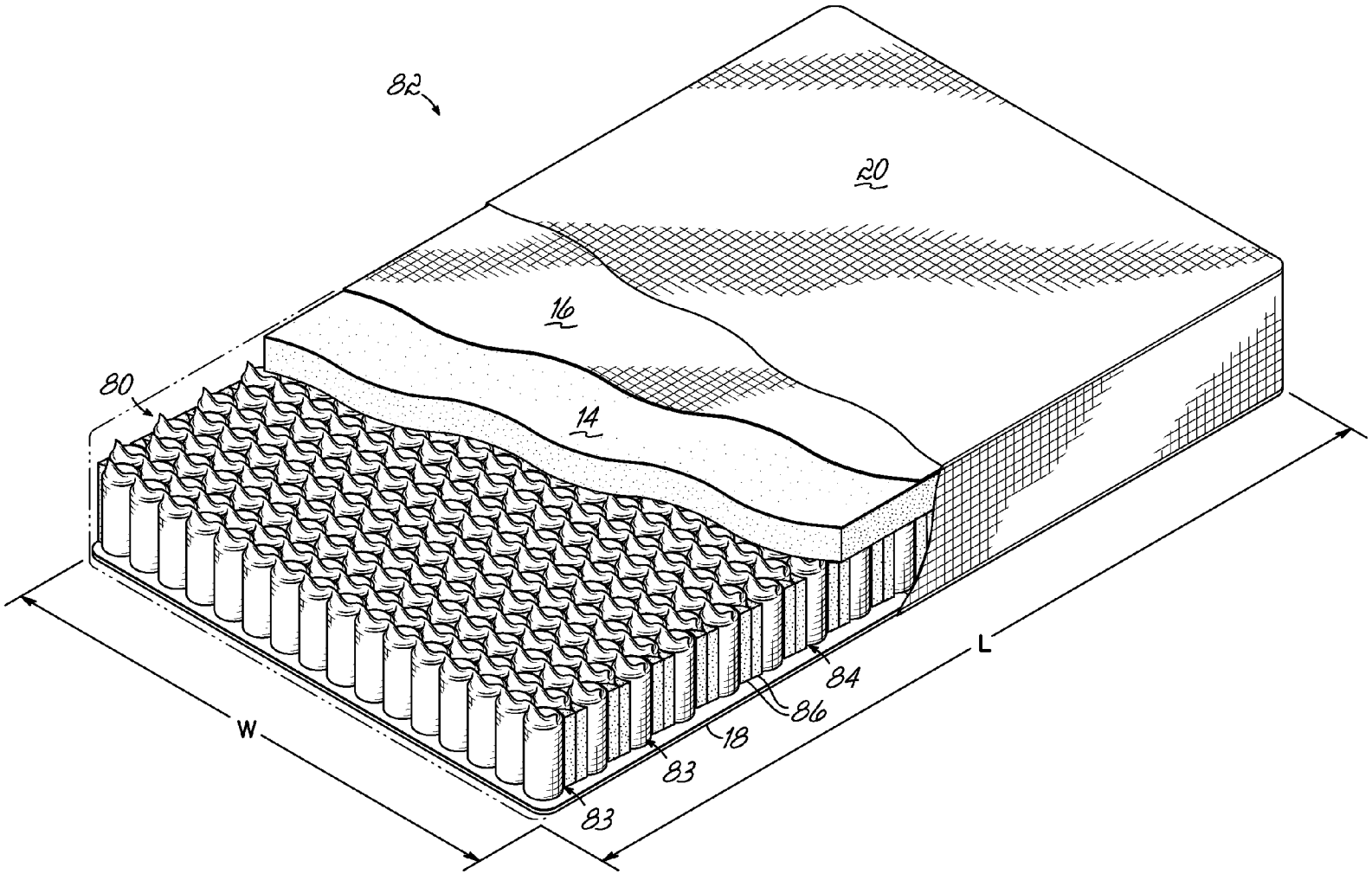
FIG. 8 is a perspective view, partially broken away, of a cushion incorporating an alternative embodiment of pocketed spring core.

FIG. 8 illustrates an alternative embodiment of pocketed spring core 80 incorporated into a single-sided mattress 82. Like the single-sided mattresses 10 and 52 described above, this single-sided mattress 82 comprises a pocketed spring core 80, a conventional foam pad 14 on top of the pocketed spring core, a base 18, a fiber pad 16 and an upholstered covering material 20. Pocketed spring core 80 may be incorporated into any bedding or seating product or cushion, including a double-sided mattress, and is not intended to be limited to single-sided mattresses, like pocketed spring core 12. The product or mattress 82 has a width W extending between side surfaces of the product and a length L extending between end surfaces of the product. It is within the contemplation of this invention that the length and width be identical or different, as illustrated.

Figure 9:
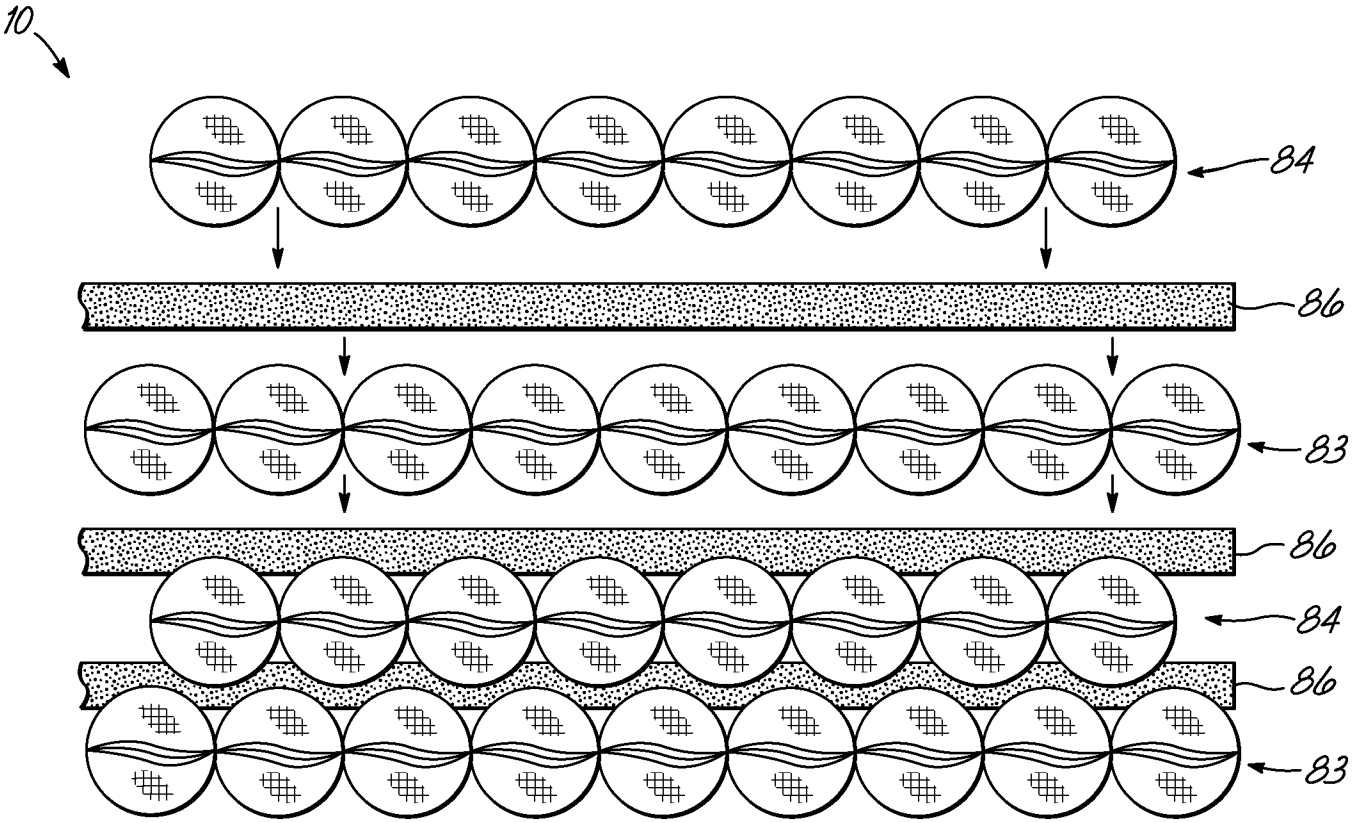
FIG. 9 is a top plan view of a portion of the process by which the alternative embodiment of pocketed spring core of FIG. 8 is made.
Figure 10:
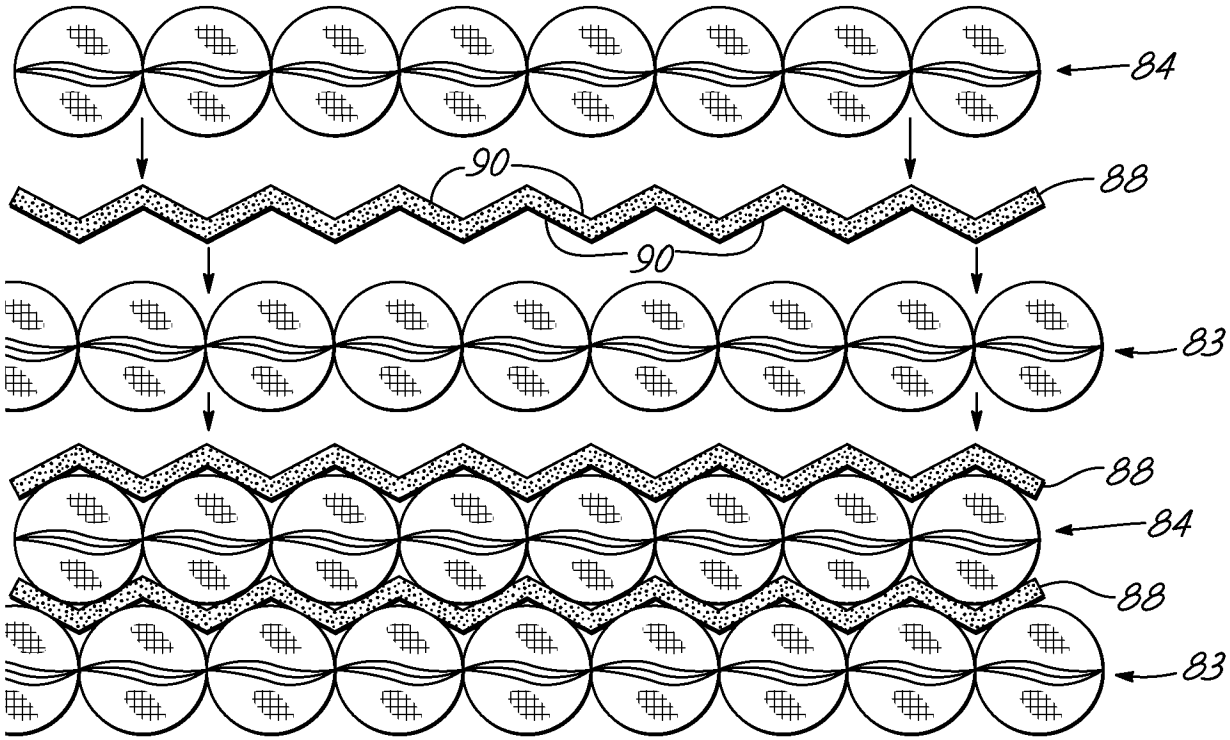
FIG. 10 is a top plan view of a portion of the process by which another embodiment of pocketed spring core is made.

As shown in FIG. 8, pocketed spring core 80 is manufactured by joining together in any known manner multiple strings of springs 84, each string of springs 84 of which extends across the full width of the product 82. As shown in FIG. 9, rows 83 of strings of springs 84 are connected to layers of cushioning material 86, which may be foam or fibers or any similar material. As shown in FIG. 9, rows 83 of strings of springs 84 may be arranged in an offset relationship as, for example, by gluing the sides of the strings to a piece of cushioning material 86 extending the width of the core 82 so as to create an assembly or matrix of springs having multiple rows and columns of pocketed springs bound to pieces of cushioning material 86 as by gluing, welding or any other conventional assembly process commonly used to create pocketed spring cores. As shown in FIG. 9, the pieces of cushioning material 86 may be rectangular. Alternatively, as shown in FIG. 10, the pieces of cushioning material 88 may be in a continuous Z-shaped pattern, each pocketed spring being located in between two recesses 90 in adjacent pieces of cushioning material 88.

Figure 11:
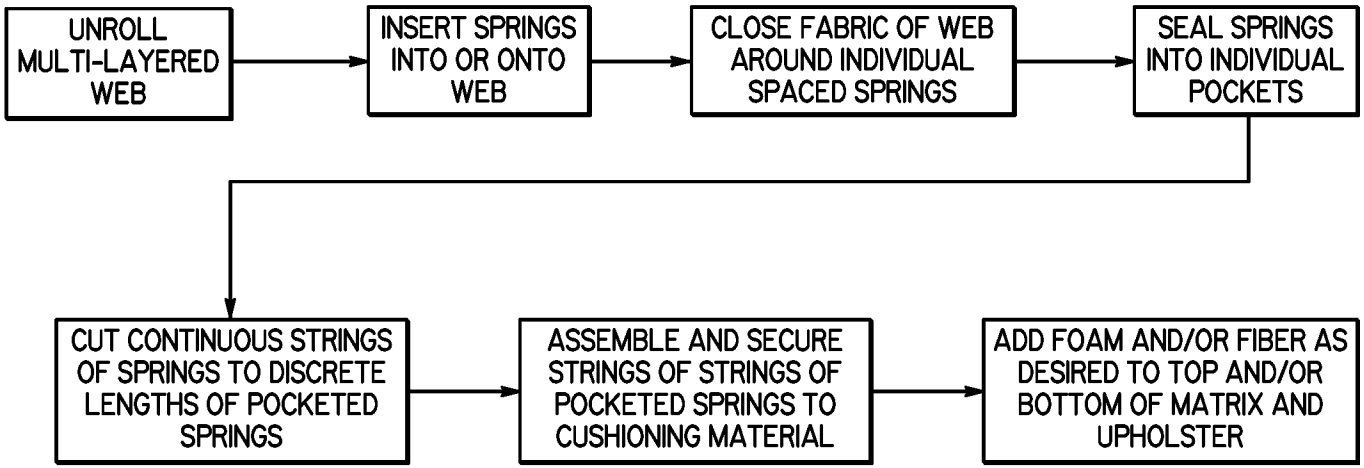
FIG. 11 is a schematic drawing of the process by which cushion spring cores made in accordance with the embodiments of FIGS. 8-10 are manufactured.

FIG. 11 illustrates the process by which the mattress 82 of FIG. 8 is manufactured utilizing the machines and processes of the above-identified patents. This process comprises starting with a roll of multi-layered fabric material, or a web, which is unrolled and has springs either inserted between a fold of the fabric web or placed onto the fabric web. Thereafter, the multi-layered fabric web is enclosed around the individually spaced springs located either between the folded springs or on the top of the fabric material. The fabric web is then closed around the spring by forming a longitudinal seal either along the side or tops of the spring. The individual pockets within which the springs are contained are then defined by vertical seams which extend for the height of the pocketed springs with each spring separated from the adjacent spring by the vertical seam. The resulting continuous string of pocketed springs is then cut into discrete lengths of pocketed springs which are then assembled and secured to cushioning material so the discrete lengths of pocketed springs are parallel to one another, but separated by layers of cushioning material to create the matrix of strings of pocketed springs illustrated in FIG. 8. The cushion is then completed by adding top cushioning materials as, for example, the pad of resilient foam material 14 and/or fiber 16 after which the complete assembly is encased within upholstered finishing material 20.

Figure 12A:
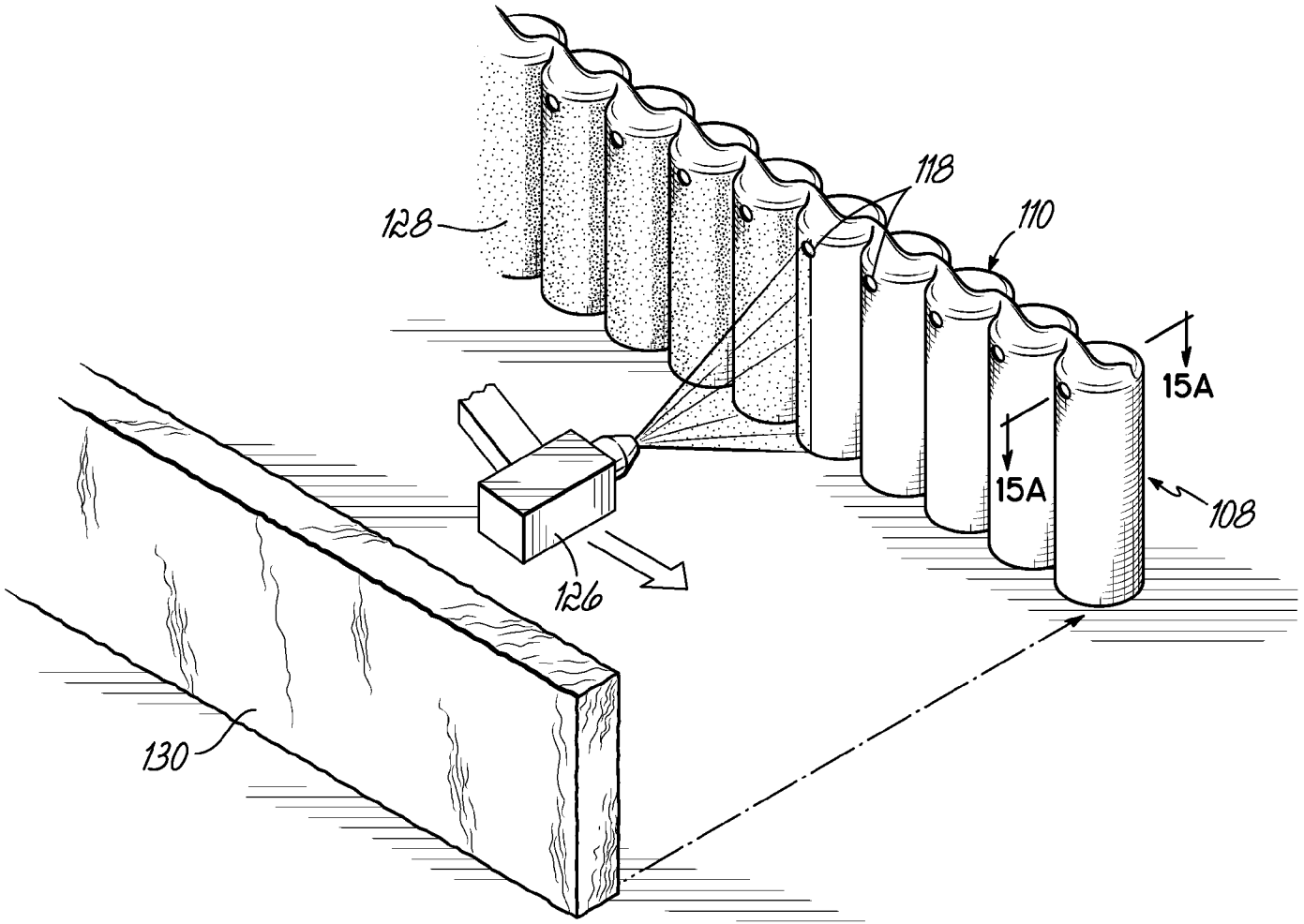
FIG. 12A is a perspective view of a sprayer being used to apply adhesive to one side of a string of springs.
Figure 14A:
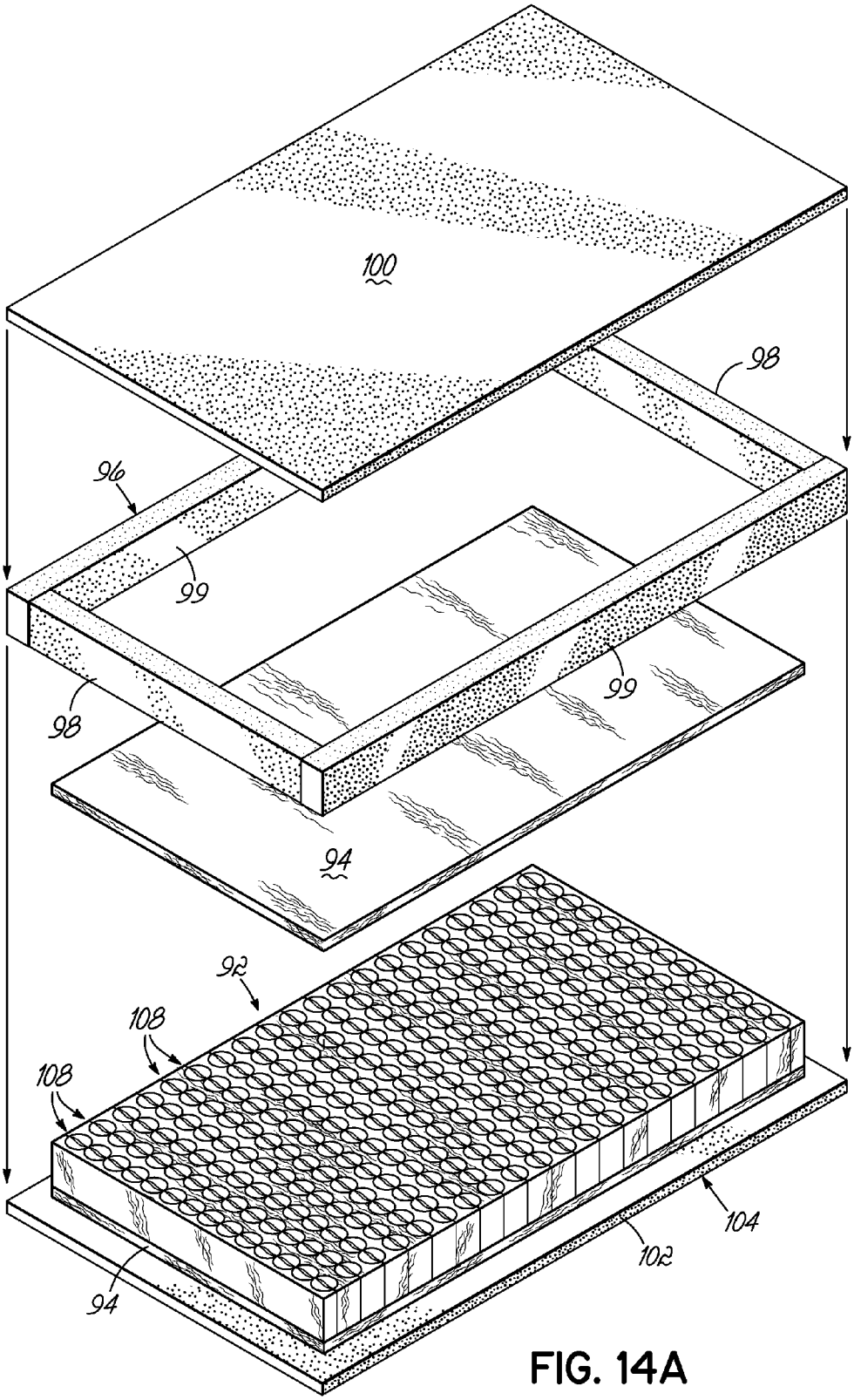
FIG. 14A is a partially disassembled perspective view of a product made in accordance with at least one aspect of the present invention.
Figure 14B:
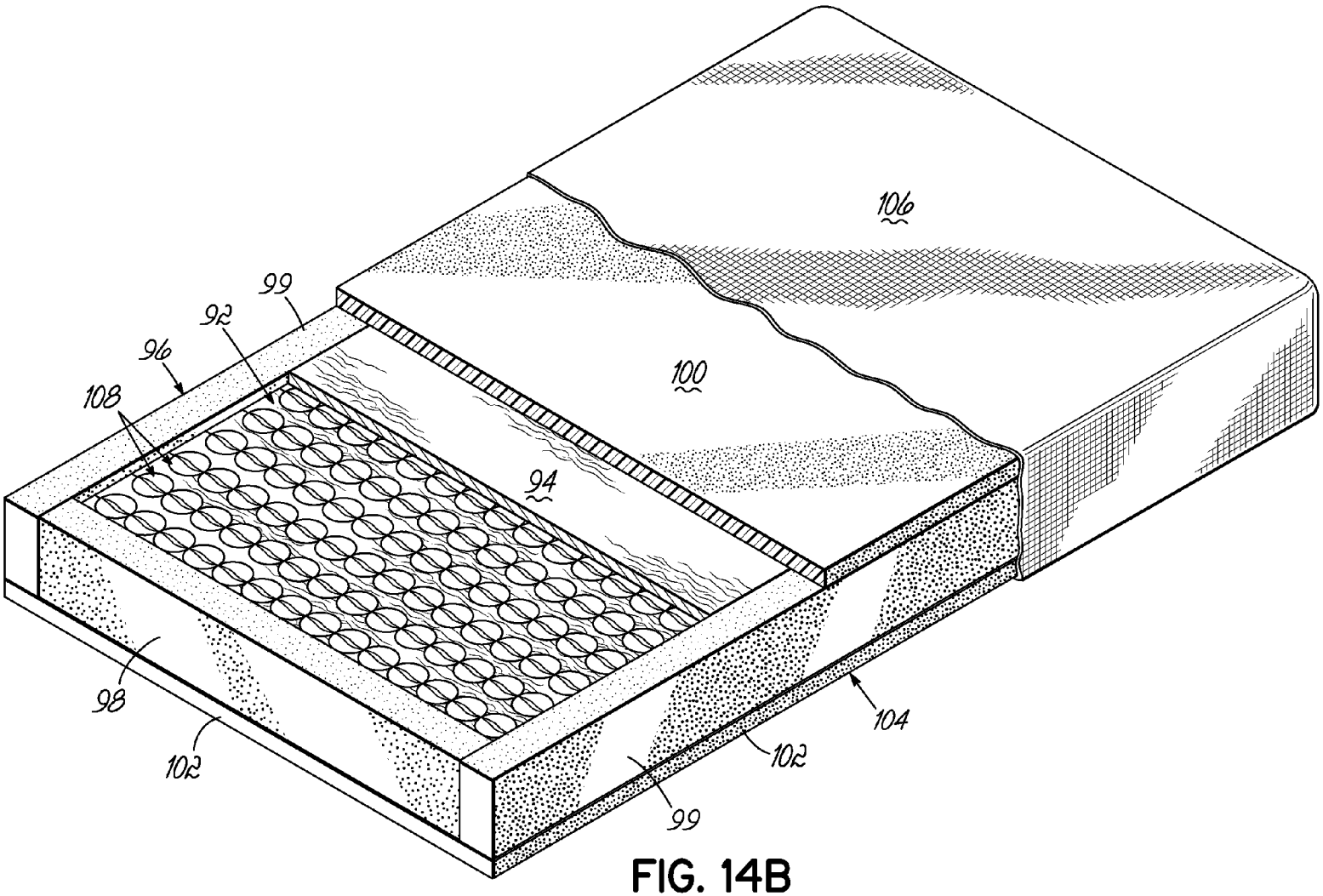
FIG. 14B is a perspective view of the product of FIG. 14A, partially broken away.

FIG. 12A illustrates a portion of a method used to make a cushion core 92, shown in FIGS. 14A and 14B. As shown in FIGS. 14A and 14B, the cushion core 92 is covered on the top and bottom with fibrous pads 94 and surrounded by a generally rectangular foam frame 96 having two end pieces 98 and two side pieces 99 secured together. A generally rectangular foam top 100 and foam bottom 102 complete the foam encasement 104 which is surrounded by an upholstered covering 106, as shown in FIG. 14B. Although FIGS. 14A and 14B illustrate one pocketed cushion core located inside a foam encasement, any of the cushion cores shown, described or contemplated within this document may be located within such a foam encasement with or without fiber pads located above or below the pocketed cushion core. Within the cushion core 92 shown in FIGS. 14A and 14B, the strings of pocketed springs 108 are oriented extending from side-to-side. However, they may be oriented the other way, extending from head-to-foot or end-to-end of the finished product, such as in some mattresses, for example.

Figure 15A:
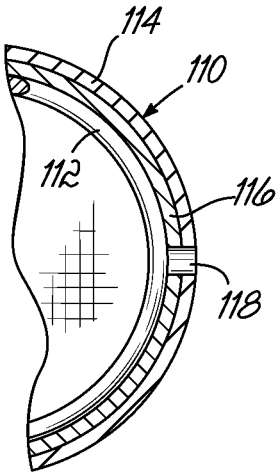
FIG. 15A is a cross-sectional view taken along the line 15A-15A of FIG. 12A.

FIG. 12A illustrates a string of pocketed springs 108 used inside the cushion core 92, shown in FIGS. 14A and 14B. The string of pocketed springs 108 comprises a plurality of inner-connected pockets of fabric material 110, each pocket containing at least one spring 112, as shown in FIG. 15A. In this embodiment, the pocket of fabric material 110 within which the spring(s) 112 of the pocketed spring assembly 92 are enclosed is a two-layered fabric material or web comprising an outer layer 114 of polyester, polypropylene or any other suitable material and an inner layer 116 of any suitable material. In accordance with the practice of this invention, one or more holes 118 extend through each fabric layer of each pocket 110 so as to make the pockets 110 of the string of springs 108 semi-impermeable to air flow as described herein. Although one hole 118 is shown in most of the pockets 110 of the string of springs 108, each pocket may have multiple holes 118. The size of the small hole or holes 118 of each pocket 110 may vary; in one embodiment these holes are 0.0625 inches in diameter or 1/16 inch to create a way for air to escape in a controlled manner when a load is placed on the string of springs 108 or enter the interior of the pocket 110 when the load is removed. Although the holes 118 are illustrated in specific locations, they may be located at any desired location with respect to the pockets 110 of the string of springs 108.

Figure 15B:
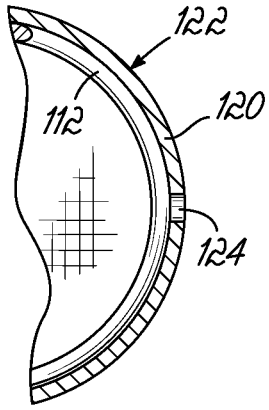
FIG. 15B is a cross-sectional view of an alternative embodiment.

FIG. 15B shows an alternative material 120 which may be used in the strings of springs of the present invention. This material is one-ply, as opposed to multiple plies. The material 120 is used for the pocket 122 to contain one or more springs 112, as with the other embodiments described herein. A hole 124 passes through the material 120 of the pocket 122. As with all of the embodiments described herein, the holes may be any desired size and at any desired locations. In addition, each pocket may have any number of such holes extending through all the plies or layers of fabric of the pocket.

Figure 12B:
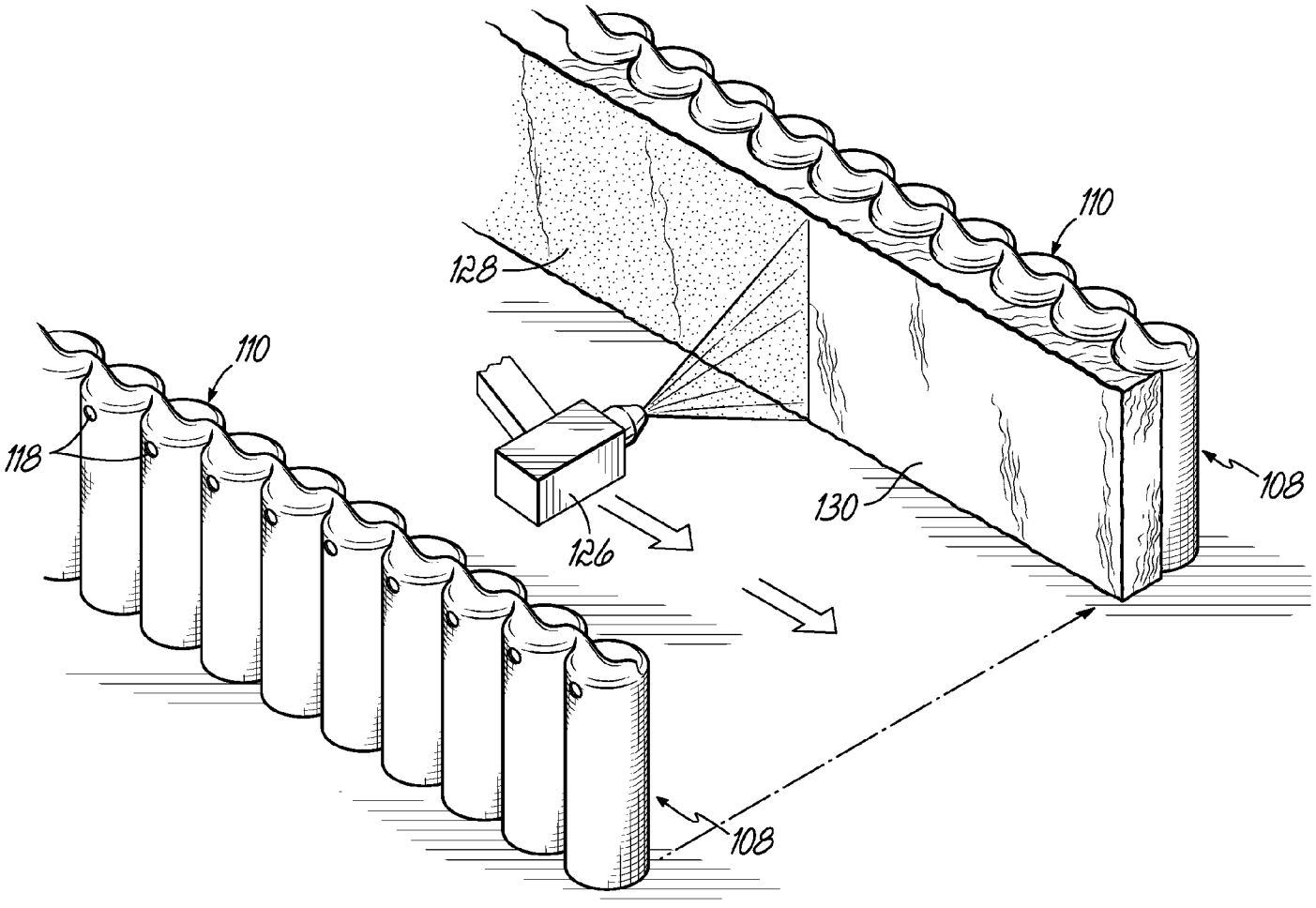
FIG. 12B is a perspective view of a sprayer being used to apply adhesive to one side of a layer of fibrous material.
Figure 12C:
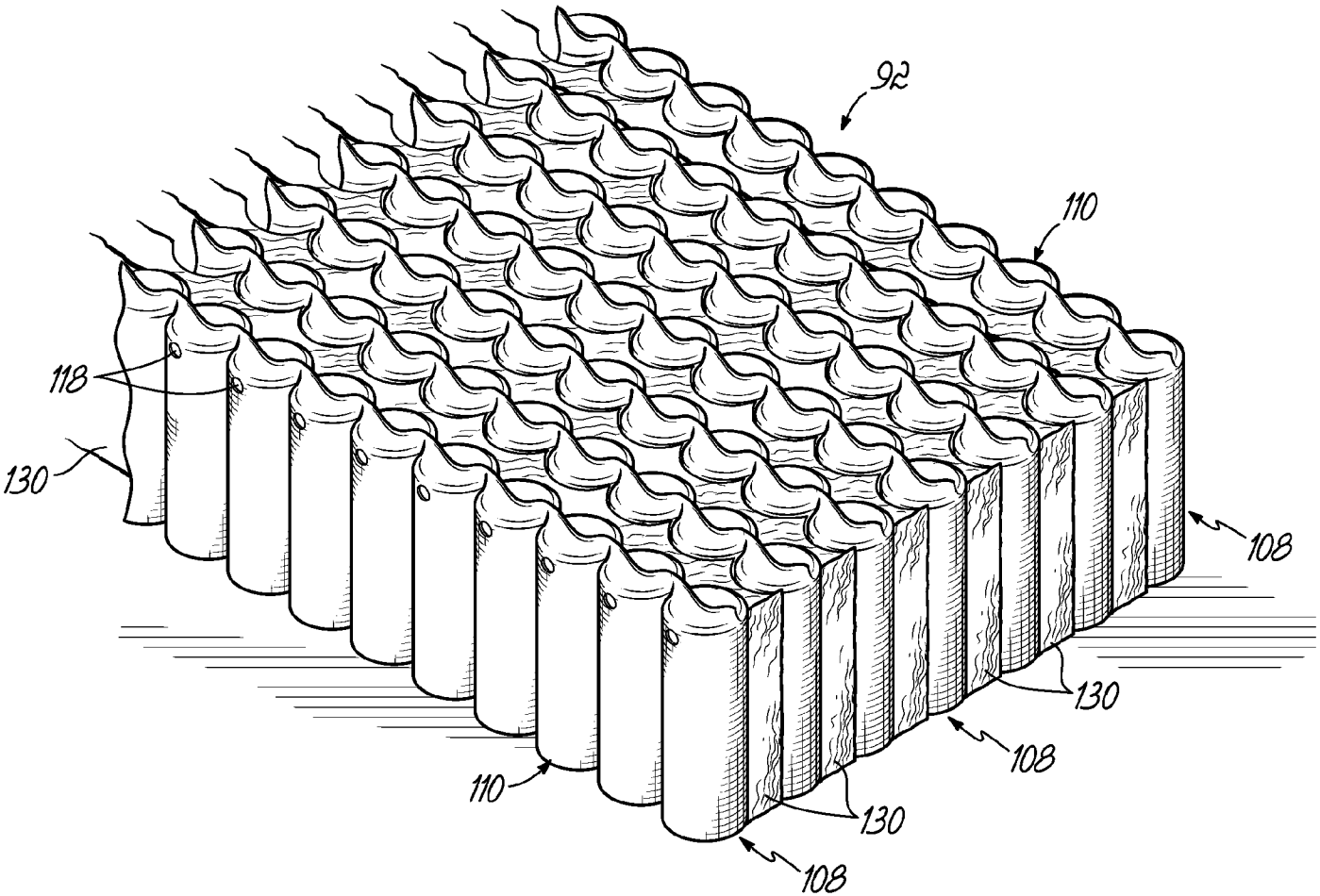
FIG. 12C is a perspective view of a portion of a cushion spring core made in accordance with at least one of the method steps shown in FIGS. 12A and/or 12B.

A movable spraying apparatus or sprayer 126 for spraying adhesive is illustrated in FIGS. 12A and 12B. Of course, the present invention does not intend to limit the sprayer to a movable sprayer; it may be stationary and the objects to be sprayed moved relative to the stationary sprayer. FIG. 12A illustrates the sprayer 126 spraying adhesive 128 onto one side surface of the string of springs 108. FIG. 12B illustrates the sprayer 126 spraying adhesive 128 onto one side surface of a layer of fibrous batting material 130. FIG. 12C shows a portion of a plurality of strings of pocketed springs 108 having fibrous batting material secured between adjacent strings of pocketed springs 108.

Figure 13:
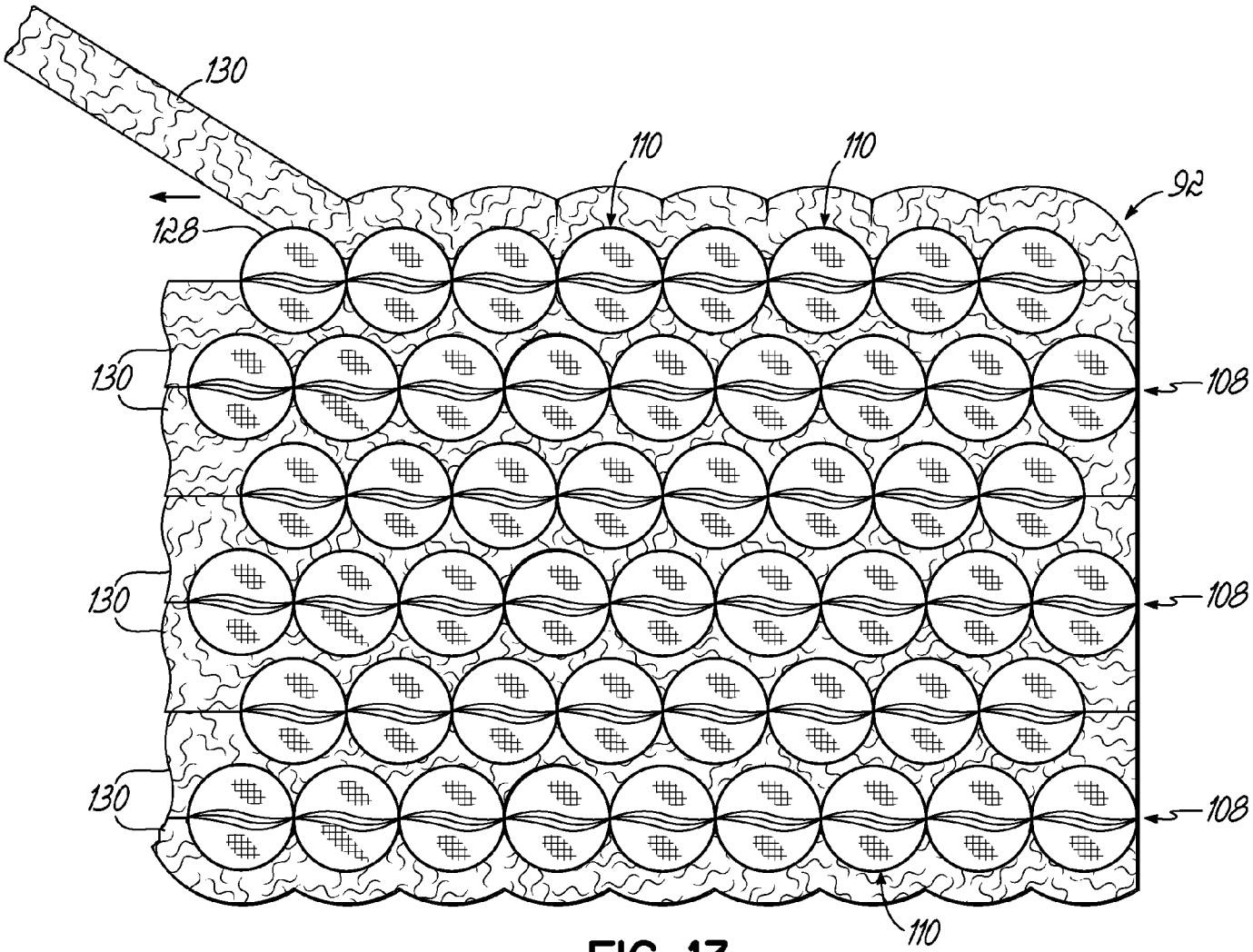
FIG. 13 is a top plan view of a portion of the process by which a portion of the cushion spring core of FIG. 12C is made.

As shown in FIG. 13, the layer of fibrous batting material 130 is pressed against the side surface of the string of pocketed springs 108 having the applied adhesive 128 to secure the fibrous batting material 130 to the string of pocketed springs 108. Due to the arcuate or curved shape of the side surfaces of the pockets of the strings of springs, the individual layers of fibrous batting material 130 assume a bumpy or non-linear configuration comprising multiple bumps. This process is repeated for each string of pocketed springs 108 in the cushion core 92. Great care is taken to make sure that as much of the surface area of each string of pocketed springs 108 is covered by fibrous batting material as is possible. Although one or more of the holes 118 in one or more of the pockets 110 of one or more of the string of springs 108 may be covered by the fibrous batting material 130, air may still flow into and out of the holes 118 due to the porous nature of the fibrous material.

The principal purpose of the layers of fibrous batting material 130 inside the pocketed cushion core 92 is to reduce the "noise" or sound the finished product makes when a person sits up off the mattress or seating product. This sound may be caused by the fabric of the pocket expanding after the load on the pocket is removed. The fibrous batting material 130 acts as a sound dampener to reduce the "noise" when a load is removed from the bedding or seating product.

As best shown in FIG. 13, adjacent strings of springs 108 are offset or moved laterally with respect to one another.

While I have described only multiple embodiments of this invention, persons skilled in this art will appreciate that other semi-impermeable fabric materials may be utilized in the practice of this invention. Similarly, such persons will appreciate that each pocket may contain any number of coil springs or other type of spring, made of any desired material. Therefore, I do not intend to be limited except by the scope of the following appended claims.

I claim:

1. A method of manufacturing a bedding or seating cushion core, which cushion core is characterized by slow and gentle compression when a load is placed on the top of the cushion core, said method comprising:

forming a continuous string of individually pocketed springs, each spring of which is contained within a pocket of fabric, said pocket of fabric being semi-impermeable to air flow through said fabric;

assembling and securing said string of springs into a matrix of pocketed springs so as to create a cushion core having fibrous material residing between adjacent strings of springs and secured thereto;

said cushion core being characterized, when a load is placed upon the top surface of the cushion core, by the rate of deflection of the cushion core being retarded by the rate at which air escapes through said semi-impermeable fabric within which the pocketed springs are contained.

2. The method of claim 1 wherein said resulting cushion core is further characterized by the rate of recovery of the core to its original height after removal of a load from the top surface of the core being retarded by the rate at which air returns through said semi-impermeable fabric into the pockets within which compressed springs are contained.

3. The method of claim 2 wherein said semi-impermeable fabric has at least one hole through the fabric to increase air flow into said pockets after a load has been removed.

4. The method of claim 2 wherein the fibrous material is sprayed on at least one of the strings of springs and fibrous material.

5. A method of manufacturing a bedding or seating cushion core, which cushion core is characterized by slow and gentle compression when a load is placed on the top of the cushion core, said method comprising:

forming strings of individually pocketed springs, each spring of which is contained within a pocket of fabric comprising multiple layers, which pocket is semi-impermeable to air flow through said pocket of fabric;

applying adhesive to at least one side of each of said strings of springs;

assembling said strings of springs into a matrix of pocketed springs to create a cushion core wherein fibrous material resides between adjacent strings of springs;

said cushion core being characterized, when a load is placed upon the top surface of the cushion core, by the rate of deflection of the cushion core being retarded and controlled by the rate at which air escapes through said semi-impermeable fabric within which the pocketed springs are contained.

6. The method of claim 5 wherein said cushion core is further characterized by the rate of recovery of the core to its original height after removal of a load from the top surface of the core being retarded by the rate at which air returns through said semi-impermeable fabric into the pockets within which compressed springs are contained.

7. The method of claim 6 wherein said semi-impermeable fabric has at least one hole through the fabric to increase air flow into said pockets after a load has been removed.

8. A method of manufacturing a bedding or seating cushion core, which cushion core is characterized by slow and gentle compression when a load is placed on the top of the cushion core, said method comprising:

forming strings of individually pocketed springs, each spring of which is contained within a pocket of fabric, which fabric is semi-impermeable to air flow through said pocket of fabric;

providing layers of fibrous material;

applying adhesive to at least one of the strings of springs and fibrous material;

securing layers of fibrous material between the strings of pocketed springs;

assembling said strings of springs into a matrix of pocketed springs to create a cushion core;

said cushion core being characterized, when a load is placed upon the top surface of the cushion core, by the rate of deflection of the cushion core being retarded and controlled by the rate at which air escapes through said semi-impermeable fabric within which the pocketed springs are contained.

9. The method of claim 8 wherein said cushion core is further characterized by the rate of recovery of the core to its original height after removal of a load from the top surface of the core being retarded by the rate at which air returns through said semi-impermeable fabric into the pockets within which compressed springs are contained.

10. The method of claim 9 wherein said semi-impermeable fabric has at least one hole through the fabric to increase air flow into said pockets after a load has been removed.

11. A method of manufacturing a bedding or seating cushion core, which cushion core is characterized by slow and gentle compression when a load is placed on the top of the cushion core, said method comprising:

forming a continuous string of individually pocketed springs, each spring of which is contained within a pocket, which pocket is semi-impermeable to air flow through said pocket due to at least one hole in the pocket;

assembling and securing said string of springs into a matrix of pocketed springs, including cushioning material located between adjacent strings of springs so as to create a cushion core having spaced top and bottom surfaces;

said resulting cushion core being characterized, when a load is placed upon the top surface of the cushion core and then removed, by the rate of return of the cushion core to its original height being retarded by the rate at which air escapes through said semi-impermeable pockets within which the springs are contained.

12. A method of manufacturing a bedding or seating cushion core, which cushion core is characterized by slow and gentle compression when a load is placed on the top of the cushion core, said method comprising:

forming a continuous string of individually pocketed springs, each spring of which is contained within a pocket comprising multiple fabric layers, which pocket is semi-impermeable to air flow through said fabric layers due to at least one hole through the fabric layers of the pocket;

cutting said continuous string of pocketed springs into individual strings of pocketed springs of discrete and predetermined length;

assembling and securing said strings of springs into a matrix of pocketed springs, including cushioning layers so as to create a cushion core having spaced top and bottom surfaces;

said resulting cushion core being characterized, when a load is placed upon the top surface of the cushion core, by the rate of deflection of the cushion core being retarded and controlled by the rate at which air escapes through said semi-impermeable pockets within which the springs are contained.

13. A bedding or seating cushion core, comprising:

a matrix of interconnected pocketed springs including fibrous material between strings of springs, each spring of which is contained within a pocket, said pocket being semi-impermeable to air flow through said pocket;

said matrix creating a cushion core having spaced top and bottom surfaces;

said cushion core being characterized, when a load is placed upon the top surface of the cushion core, by the rate of deflection of the cushion core being retarded by the rate at which air escapes through said semi-impermeable pockets within which the pocketed springs are contained.

14. The cushion core of claim 13 wherein said pocket comprises multiple layers of fabric.

15. The cushion core of claim 13 wherein said pocket comprises three layers.

16. The cushion core of claim 15 wherein said has at least one hole through the pocket.

17. A bedding or seating cushion core, comprising:

a matrix of interconnected pocketed springs, each spring of which is contained within a pocket of fabric, which pocket of fabric is semi-impermeable to air flow through said fabric due to at least one hole through the pocket of fabric;

cushioning material between rows of pocketed springs;

said matrix creating a cushion core having spaced top and bottom surfaces;

said cushion core being characterized, when a load is placed upon the top surface of the cushion core and then removed, by the rate of return of the cushion core to its original height being retarded by the rate at which air escapes through said semi-impermeable pocket of fabric within which the springs are contained.

18. The cushion core of claim 17 wherein said semi-impermeable pocket of fabric comprises at least one layer of polypropylene non-woven fabric material.

19. The cushion core of claim 17 wherein said semi-impermeable pocket of fabric comprises two outer layers of polypropylene non-woven fabric material and a middle layer of polyolefin plastic film.

* * * * *

UNITED STATES PATENT AND TRADEMARK OFFICE

CERTIFICATE OF CORRECTION

PATENT NO. : 8,484,784 B2
APPLICATION NO. : 13/038859
DATED : July 16, 2013
INVENTOR(S) : Niels S. Mossbeck It is certified that error appears in the above-identified patent and that said Letters Patent is hereby corrected as shown below:

In the Specification

Column 2

Line 1, delete “cushion or mattress”.

Line 6, delete “cushion or mattress”.

Line 38, “may be not be” should be --may not be--.

In the Claims

Column 12

Line 28, Claim 16, after “said”, insert --pocket--.

Signed and Sealed this
Seventeenth Day of September, 2013

Teresa Stanek Rea
*Deputy Director of the United States Patent and Trademark Office*